US008025489B2

(12) United States Patent
Shacklee et al.

(10) Patent No.: US 8,025,489 B2
(45) Date of Patent: Sep. 27, 2011

(54) PORTABLE, REMOTE ELECTROMAGNETIC POWER SYSTEM

(76) Inventors: William Francis Shacklee, Kingsport, TN (US); Gerald W. Shacklee, Kingsport, TN (US); Craig E. Shacklee, Kingsport, TN (US)

( * ) Notice: Subject to any disclaimer, the term of this patent is extended or adjusted under 35 U.S.C. 154(b) by 651 days.

(21) Appl. No.: 12/231,537

(22) Filed: Sep. 4, 2008

(65) Prior Publication Data

US 2010/0054970 A1 Mar. 4, 2010

(51) Int. Cl.
*F04B 17/04* (2006.01)
*F16D 31/02* (2006.01)

(52) U.S. Cl. ..... 417/417; 417/411; 417/313; 417/536; 91/4 A; 60/416; 60/413; 60/456; 92/144; 137/565.01; 137/565.29; 137/565.33

(58) Field of Classification Search ..... 417/415–417, 417/534, 536, 411, 313; 137/565.01–565.36; 91/4 R, 4 A; 60/413, 416, 456; 92/144
See application file for complete search history.

(56) References Cited

U.S. PATENT DOCUMENTS

| | | | |
|---|---|---|---|
| 3,863,082 | A | 1/1975 | Gillott |
| 4,163,911 | A | 8/1979 | Simes |
| 4,840,163 | A | 6/1989 | Alsobrooks |
| 4,883,252 | A | 11/1989 | Mesenich |
| 5,166,563 | A | 11/1992 | Bassine |
| 5,497,135 | A | 3/1996 | Wisskirchen |
| 6,799,746 | B2 | 10/2004 | Schafer |

*Primary Examiner* — Mariceli Santiago
(74) *Attorney, Agent, or Firm* — Theresa M. Seal

(57) ABSTRACT

A portable electromagnetic power system used as a remote alternate power source includes a water tank having an oil reservoir mounted on top of the tank with four cylinders extending through the tank and the two outer cylinders denoted the pressure cylinders and the two inner cylinders serving as accumulators with electromagnets mounted at the ends of each pressure cylinder for reciprocating an internal floating piston and each inner cylinder having a permanent magnet mounted at one end for actuating a magnetized floating piston disposed therein and each magnetized floating piston dividing the inner cylinder into an air chamber portion and a fluid chamber portion with the oil reservoir and the cylinders all in fluid flow registration with each other and the inner cylinders connected to a working pressure line that connects to a device, such as a hydraulic motor, so that the outer cylinder develop working pressure concomitant with the flow of oil therein that is directed to the inner (accumulator) cylinders for providing working pressure to power a device such as a hydraulic motor.

9 Claims, 5 Drawing Sheets

PORTABLE, REMOTE ELECTROMAGNETIC POWER SYSTEM

FIELD OF THE INVENTION

The present invention pertains to portable power systems, and more particularly pertains to a portable, remote electromagnetic power system that provides power without the use of a combustion engine.

BACKGROUND OF THE INVENTION

Power generating systems are ubiquitous in our modern industrial and technological society. They are needed to power everything from factories and electrical grid systems to sprayers, washers, cleaners and heaters for small scale and residential consumer use. Power generating systems can be electrically powered or powered by or through an internal combustion engine. However, many situations and occasions arise where power is needed but is not readily available; such situations and occasions can range from vacationing and camping activities at remote sites to construction and work sites far from readily available power sources. There is also the need for portable systems to provide power to a turbine, hydraulic motor or heating system of an automotive vehicle such as a tractor-trailer. Emergency situations and first responder situations also require power as there are often power shortages and power outages accompany such emergency situations. One disadvantage of power systems that have some portability is that they include combustion engines which thus require the storage and transport of fuel, such as kerosene or gasoline, along with the power producing system—and this adds to the cost, complexity, and safety concerns for the power system. Thus, the prior art discloses a number of power system many of which include magnets to actuate linear reciprocable pistons.

For example, the Gillott et al. patent (U.S. Pat. No. 3,863,082) discloses an improved permanent magnet motor and an improved air delivery system so that the motor provides the linear drive for a respirator piston.

The Simes et al. patent (U.S. Pat. No. 4,163,911) discloses an improved permanent with an improved air delivery system for respirators wherein a permanent magnet translational motor provides the linear drive for the respirator piston.

The Alsobrooks et al. patent (U.S. Pat. No. 4,840,163) discloses a fuel injection fuel supply system for a combustion engine that includes a fuel injector valve for metering and injecting all the required fuel to the engine.

The Mesenich patent (U.S. Pat. No. 4,883,252) discloses a fuel injection fuel supply system for a combustion engine for metering and injecting fuel to the engine induction system.

The Bassine patent (U.S. Pat. No. 5,166,563) discloses a magnetically actuated linear displacement compressor that includes a cylinder, a diaphragm, a means for introducing gas into each of the cylinder portions, and a linear actuator surrounded by groups of windings that can be selectively energized and de-energized.

The Wisskirchen et al. patent (U.S. Pat. No. 5,497,135) discloses a bistable electromagnet is moved from one operating position into the other operating position by a short direct-current pulse.

The Schafer patent (U.S. Pat. No. 6,799,746 B2) discloses an electromagnet that is applied to a proportional magnet that is arranged within a hydraulic system of an apparatus for varying the control times of inlet and outlet valves of an internal combustion engine.

Nonetheless, despite the ingenuity of the above devices, there remains a need for a portable remote alternate power system for ground use and without the use of a combustion engine.

SUMMARY OF THE INVENTION

The present invention comprehends power systems, and especially power systems that don't involve or include combustion engines, for use in situations and locations lacking a readily available power source for mechanical equipment such as engines, pumps, motors, etc.; and also for use in emergency situations ranging from accidents to natural disasters, where power is needed in remote areas on site for tools, equipment, and generators. The present invention more specifically comprehends a portable remote electromagnetic power system whose parts and components can be sized and adapted for the power supply to which it is to be interconnected.

Thus, the portable remote electromagnetic power system (PREPS) includes a water tank and an oil reservoir containing oil mounted on upper side of the water tank with the water tank capable of varying in size from a small fabricated tank to the size of a railroad car tanker. Disposed within the water tank is a plurality (four in the preferred embodiment) of stainless steel cylinders extending transversely through the water tank. Each cylinder includes a pair of end caps that project outward and external to the water tank and are in fluid flow communication with the oil reservoir while water contained within the water tank serves as a coolant for the steel cylinders and the components contained within the steel cylinders.

The two cylinders denoted the outside cylinders each include a pair of electromagnets internally disposed within the end caps and a free floating piston that linearly and reciprocably moves within each respective outside cylinder between the electromagnets. The two cylinders denoted the inside cylinders are used as accumulators and each inside cylinders includes a shield at one end with a permanent magnet mounted and enclosed therein and end caps mounted at the opposite ends. Disposed within each inside cylinder is a floating magnetized piston that is opposed in charge (magnetism) to the permanent magnet. The floating magnetized pistons fill the diameter of the inside cylinders and define an air chamber portion with air trapped therein adjacent the permanent magnet end and a fluid chamber portion adjacent the end having the end caps. Oil from the oil reservoir enters the fluid chamber portions of the inside (accumulator) cylinders via the outside (pressure) cylinders. Each end cap includes two one-way valves with one one-way valve allowing fluid ingress into the fluid chamber portion and the other one-way valve allowing for fluid egress from the fluid chamber portion.

Four fluid (oil) supply lines extend from the oil reservoir with one fluid supply line connected to each end cap of each outside cylinder, and each fluid supply line has its own shutoff valve. A one-way valve is mounted to each fluid supply line adjacent the connection of that fluid supply line to each end cap for maintaining uni-directional fluid flow into the ends of the outside cylinders. The outside cylinders are interconnected to the end caps of the adjacent inside cylinders by oil supply lines and these oil supply lines also include one-way valves to maintain uni-directional fluid flow into the inside cylinders. A mechanical device such as an hydraulic motor is interconnected to the inside cylinders by a working pressure supply line and a pressure regulator valve is mounted on the working pressure supply line to regulate fluid flow pressure to the motor and a fluid return line runs from the motor back to the oil reservoir for returning oil to the oil reservoir.

The outside cylinders serve as the pressure cylinders and the inside cylinders serve as accumulators. Each pair of electromagnets for each outside cylinder are programmed to be simultaneously energized and de-energized thereby actuating the movement of the free floating pistons which action forces oil through the corresponding oil supply lines and one-way valves and into the fluid chamber portions of the adjacent insider (accumulator) cylinders. As oil from both outside cylinders flows through the oil supply lines into the inside cylinders, air is trapped between the floating magnetized pistons and the permanent magnets of the inside cylinders. This creates a working pressure whereupon oil now held under pressure is forced out of the inside cylinders through the working pressure supply line and the pressure regulator valve for providing the working pressure for operating and running a device such as the hydraulic motor.

It is an objective of the present invention to provide a portable remote electromagnetic power system that can be used to power a turbine, a hydraulic motor of other device.

It is another objective of the present invention to provide a portable remote electromagnetic power system that can be scaled up or down from a small fabricated tank to the size of a railroad tank car.

It is still another objective of the present invention is to provide a portable remote electromagnetic power system that is adapted for ground use and operates without the use of a combustion engine.

It is still yet another objective of the present invention to provide a portable remote electromagnetic power system that uses little or no fuel.

Another objective of the present invention is to provide a portable remote electromagnetic power system that is simple to operate and is constructed of readily available parts.

Still another objective of the present invention is to provide a portable remote electromagnetic power system that does not require oxygen, does not have an open flame, and doesn't exude any exhaust.

Still yet another objective of the present invention is to provide a portable remote electromagnetic power system that is easily and quickly adaptable for use in emergency situations that include natural disasters such as tornadoes, earthquakes, and hurricanes.

A still further objective of the present invention is to provide a portable remote electromagnetic power system that is adaptable for easy and quick use in remote areas, as it requires little fuel.

Yet another objective of the present invention is to provide a portable remote electromagnetic power system that is able to generate electrical power to run the heater of a cab of a tractor-trailer thereby reducing or eliminating the consumption and burning of gasoline.

Yet still another objective of the present invention is to provide a portable remote electromagnetic power system that can be used to prevent the diesel fuel of vehicles including trucks and tractor-trailers from getting cold in cold climates.

Still a further objective of the present invention is to provide a portable remote electromagnetic power system in which the parts and components of the system can be varied to correspond to the size of the power supply.

These and other objects, features, and advantages will become apparent to those skilled in the art upon a perusal of the following detailed description when read in conjunction with the accompanying drawing figures and appended claims.

DETAILED DESCRIPTION OF THE PREFERRED EMBODIMENT

Figure 1:
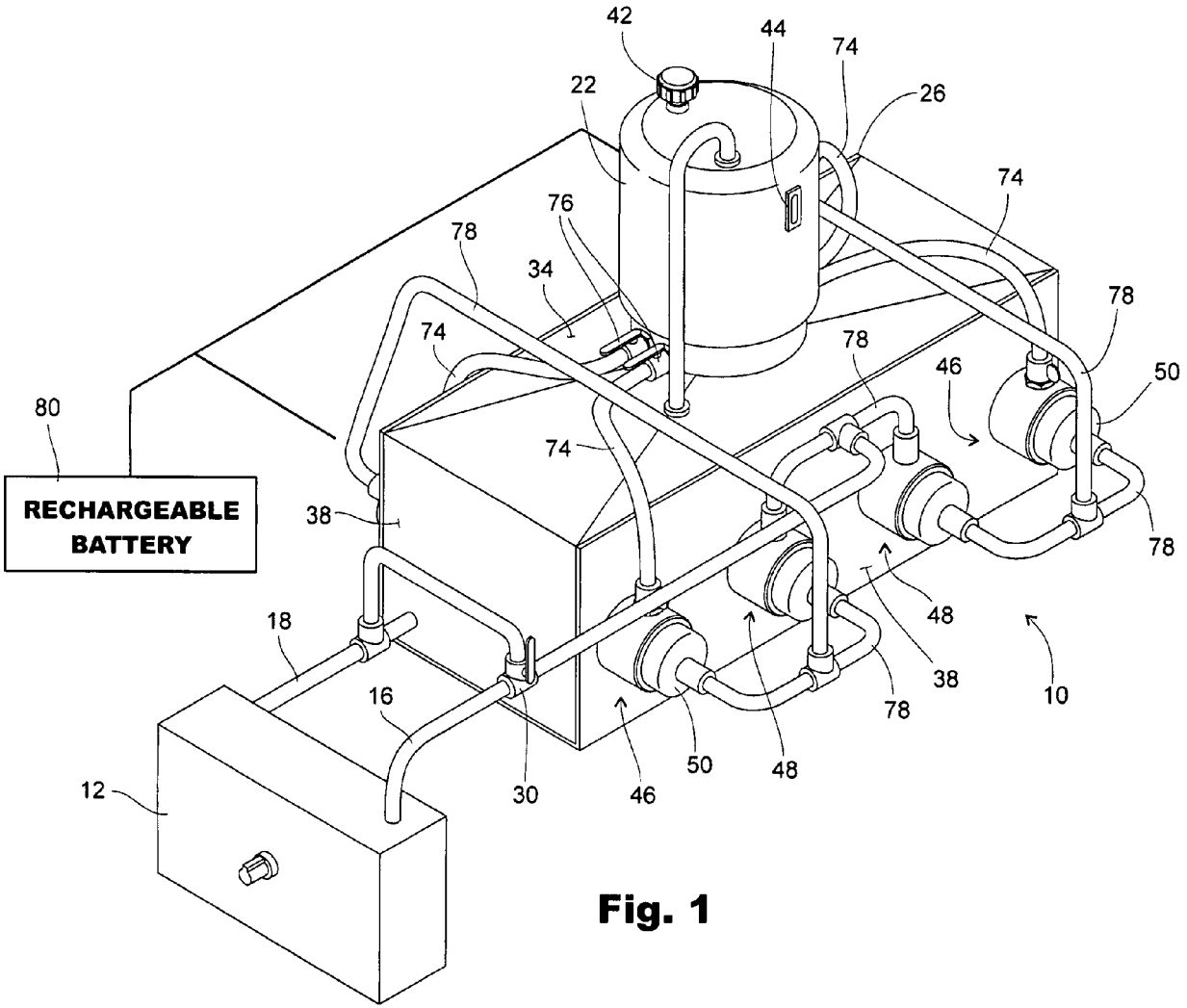
FIG. 1 is a perspective view of the portable remote electromagnetic power system illustrating the primary structural components of the system.
Figure 2:
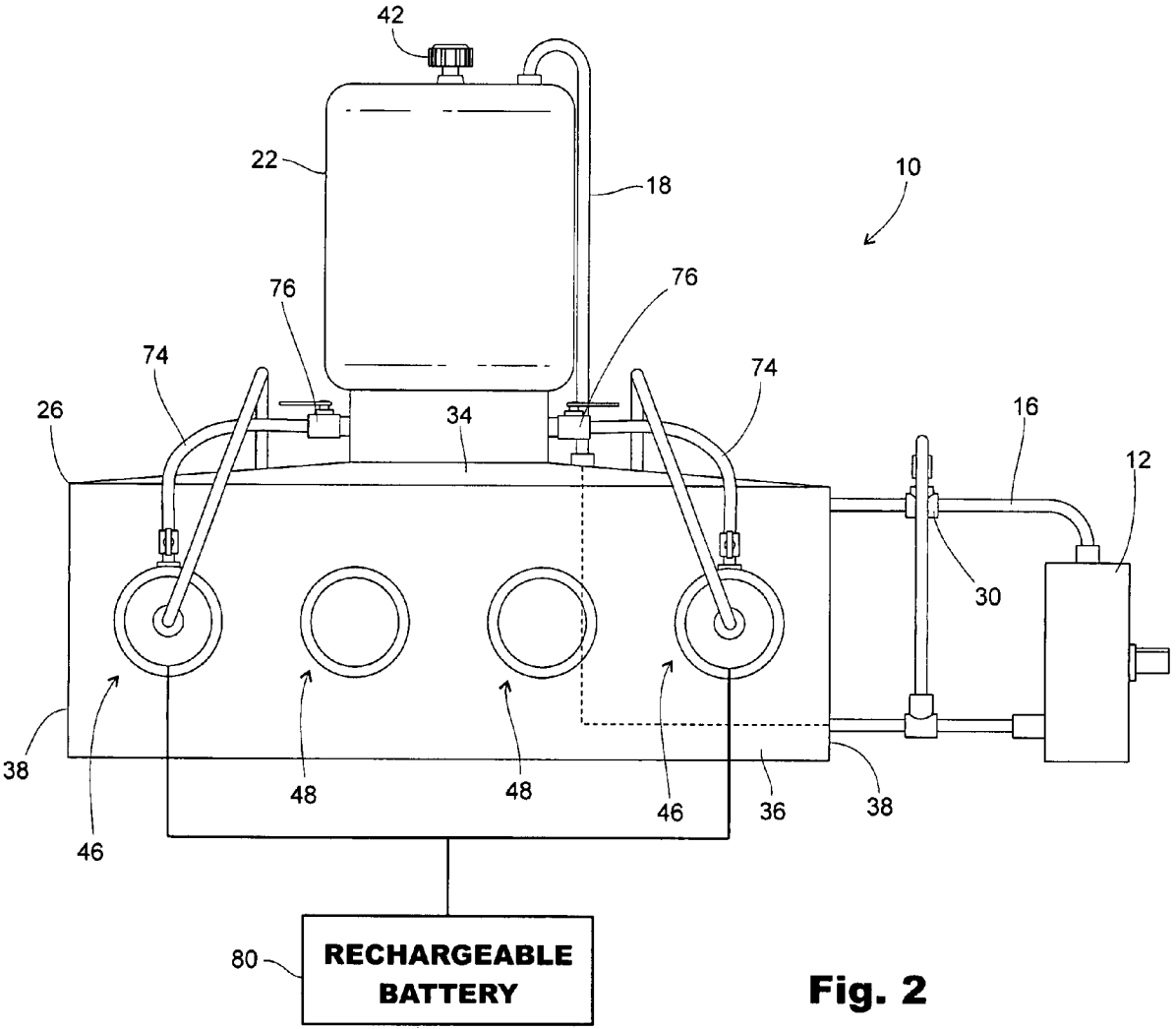
FIG. 2 is a side elevational view of the portable remote electromagnetic power system illustrating the primary structural components of the system including the rechargeable battery.
Figure 3:
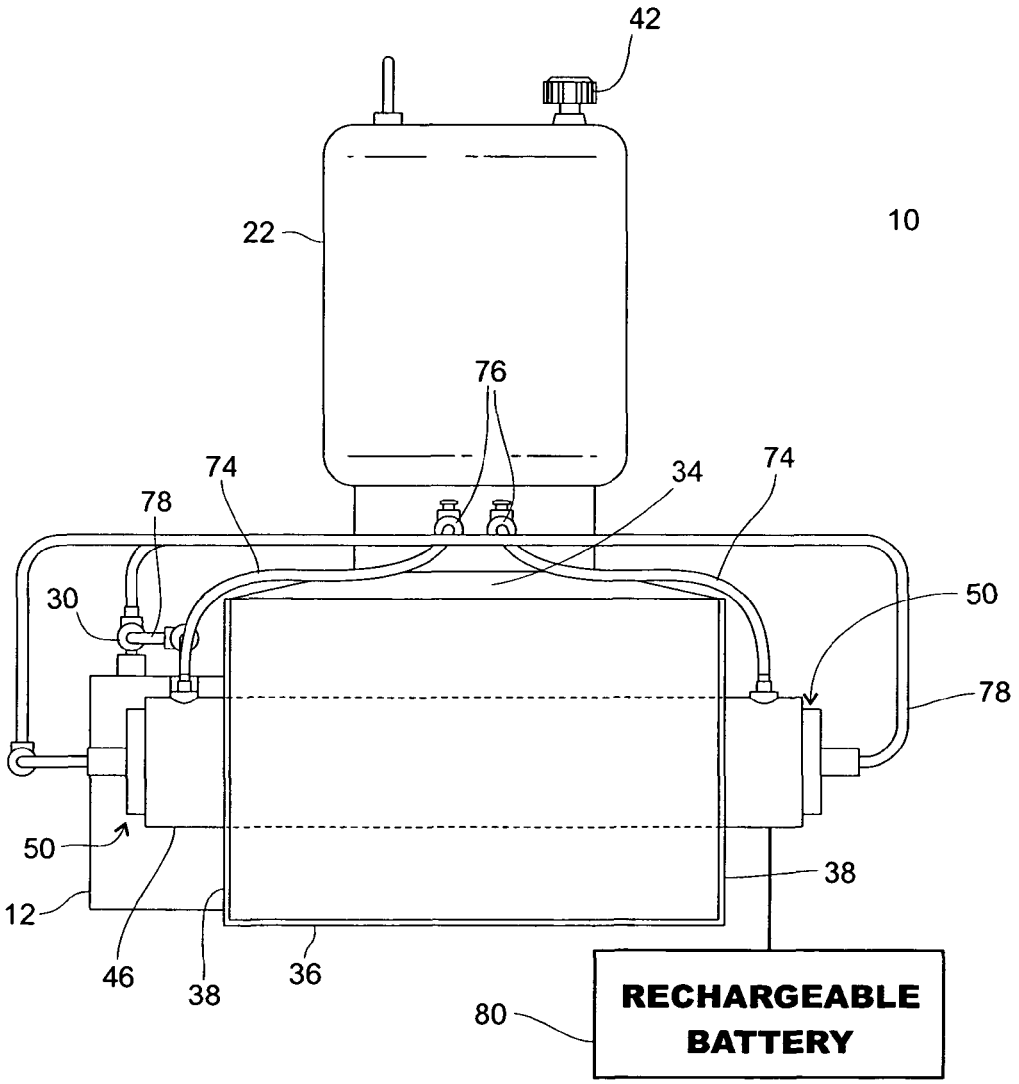
FIG. 3 is a side elevational view of the portable remote electromagnetic power system illustrating the primary structural components of the system.

Illustrated in FIGS. 1-5 is a portable remote electromagnetic power system (PREPS) 10 for providing working pressure for powering any of a variety of devices that can include, but are not limited to, turbines, engines, hydraulic motors, similar type motors, heaters, portable generators, etc., and for which the various components and parts of the system 10 can be varied in size and shape commensurate with the size of the power supply—and the power requirements—for which the system 10 is being utilized. The portable remote electromagnetic power system 10 is ideal for emergency situations where there isn't any available power source or where the power source has been disrupted or destroyed. The portable power system 10 of the present invention supplies working pressure (power) to the gearbox 12 of a mechanical device such as a hydraulic motor 14 via a main working pressure fluid line 16 and a fluid return line 18 that extends from the motor, turbine, engine, etc. such as the hydraulic motor 14 in the representative example of FIG. 1 for the return of fluid (which in the preferred embodiment is oil) back to the oil reservoir 22. The system 10 of the present invention is thus a closed system. The fluid return line 18 includes a curvilinear shape 24 as it extends through a water tank 26 with the curvilinear form or shape 24 for increasing the amount of surface area that comes in contact with the water 28 thereby facilitating the cooling of the fluid (oil) before the oil returns to the oil reservoir 22. A pressure regulator valve 30 is mounted on the working pressure fluid line 16 for regulating fluid pressure to the device such as the gearbox 12 that is drivingly interconnected to the hydraulic motor 14 shown as the representative example of FIGS. 1 and 4.

Thus, as shown in FIGS. 1-5, the portable power system 10 includes the water tank 26 having an internal cavity 32 that is substantially filled with the coolant (water 28) for cooling components and parts hereinafter further described. The water tank 26 can range and vary in size and shape from a small fabricated tank up to a semi-truck tank or even to a railroad car tank. The water tank 26 can be manufactured from aluminum, stainless steel, or fiberglass, and the water tank 26 includes an upper side 34, a lower or bottom floor 36, and four adjoined sidewalls 38. A plurality of apertures (at least four) are formed on each opposed sidewall 38 denoted the long sidewall with the apertures on one sidewall 38 being aligned with the apertures on the opposite long sidewall 38.

As shown in FIGS. 1-4, the oil reservoir 22 is mounted upon the upper side 34 of the water tank 26. The oil reservoir 22 includes a combination air bleed or breather and fill port 42 with an accompanying lid or cap and a sight gauge 44 to determine the oil level within the reservoir 22 and thus if the oil reservoir 22 needs filled. Extending transversely through or across the water tank 28 are a plurality of spaced-apart cylinders with the cylinders registering with the apertures of the long sidewalls 38 so that their ends project externally past the long sidewalls 38. The cylinders are more specifically denoted as two outer pressure cylinders 46 and two inner accumulator cylinders 48 with one outer pressure cylinder 46 associated with the adjacent inner accumulator cylinder 48 and the other outer pressure cylinder 46 associated with the other adjacent inner accumulator cylinder 48. Each pair of pressure and accumulator cylinders 46 and 48 are in direct fluid flow communication with each other; and all of the cylinders 46 and 48 are in fluid flow communication with the oil reservoir 22.

Figure 4:
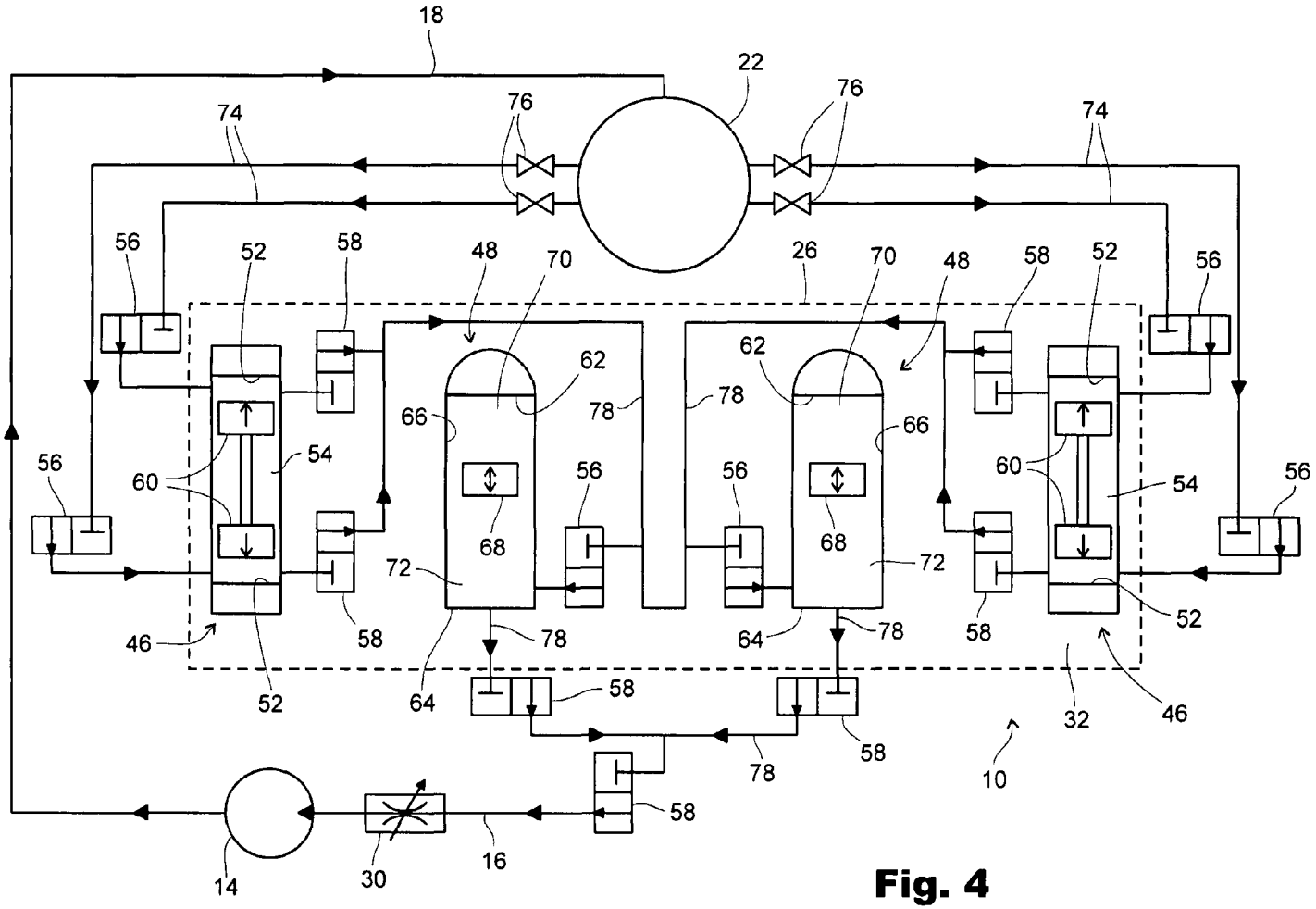
FIG. 4 is a representative electrical schematic of the portable remote electromagnetic power system illustrating the fluid flow throughout the system and the numerous valves that control and regulate the fluid flow.
Figure 5:
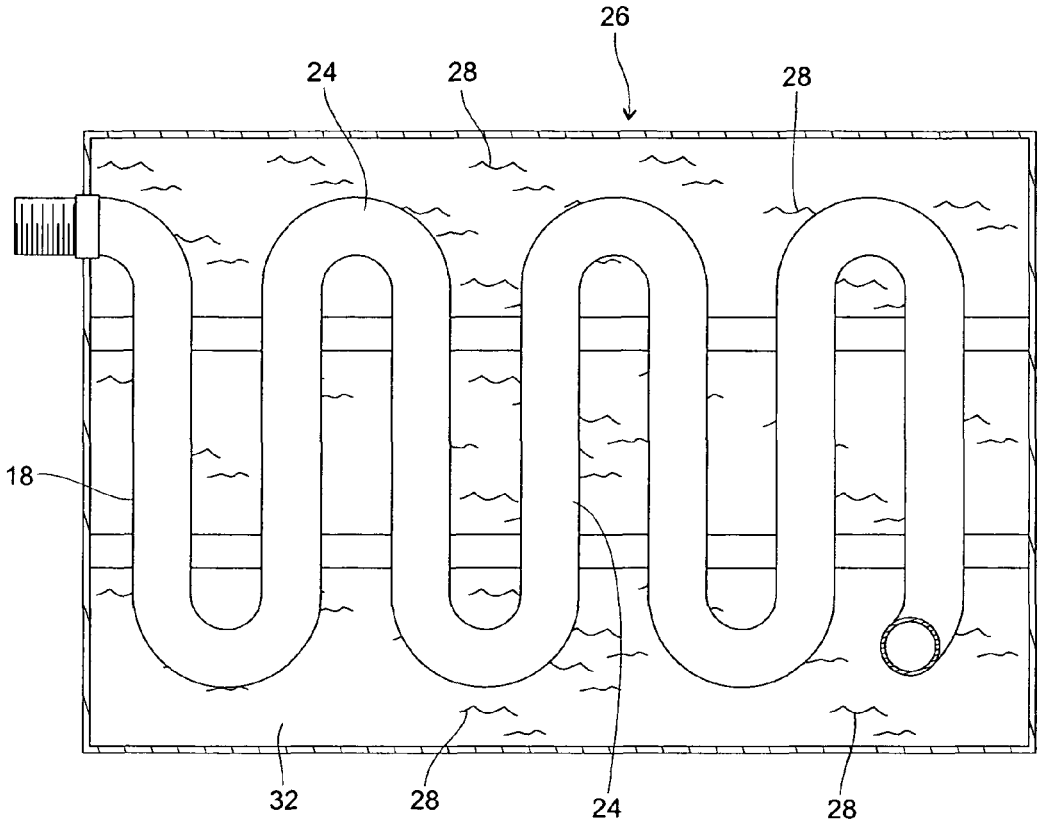
FIG. 5 is a top plan view of the portable remote electromagnetic power system illustrating the oil return line through the water tank back to the oil reservoir.

As shown in FIG. 4, each outer pressure cylinder 46 includes a pair of opposed end caps or shields 50 and disposed within each end cap 50 is an electromagnet 52. Each pressure cylinder 46 also defines an interior chamber 54, and each end cap 50 of each pressure cylinder 46 includes a one-way in valve 56 to allow fluid flow (oil) into the pressure cylinder 46 and interior chamber 54 and a one-way out valve 58 to allow for fluid flow (oil) out of the chamber 54 and pressure cylinder 46. Disposed within each interior chamber 54 is a floating piston 60 that is reciprocably movable within the pressure cylinder 46 as a result of the actions and actuations of the electromagnets 52 and the fluid flow into either end of the pressure cylinders 46 as will be hereinafter further described. The floating pistons 60 are actually dual-headed pistons interconnected by a connecting rod but for simplicity they will each be referred to as floating pistons 60. Fluid enters the area of the interior chamber 54 adjacent one end cap 50 via the one-way in valve 56 mounted on that end cap 50 and fluid is ejected or forced out from that selfsame area of the interior chamber 54 adjacent the one-way out valve 58 on the selfsame end cap 50. The one-way in valve 56 and the one-way out valve 58 on the opposite end cap 50 allow for the commensurate fluid flow movement into and out from that end of the pressure cylinder 46.

As illustrated in FIGS. 1-4 each pressure cylinder 46 is in direct fluid flow communication with the adjacent inner accumulator cylinder 48. Each inner cylinder 48 includes one end having a permanent magnet 62 mounted thereto and enclosed therein and an opposite accumulator end cap 64 with each end cap 64 having one one-way in valve 56 and one one-way out valve 58 so that fluid is able to flow into the respective accumulator cylinder 48 and flow out of the accumulator cylinder 48 in a controlled manner. Each accumulator cylinder 48 defines an inner cavity 66 and disposed within each inner cavity 66 is a floating magnetized piston 68 that is reciprocably movable within the respective inner cavity 66 of the accumulator cylinder 48. The disposition of the floating magnetized piston 68 divides or demarcates the inner cavity 66 into an air chamber portion 70 wherein air is trapped and held under pressure and a fluid chamber portion 72 wherein fluid is trapped and held under pressure. While the floating magnetized pistons 68 are shown as not completely filling the diameter inner cavities 66 of the accumulator cylinders 48 in the schematic of FIG. 4, the floating magnetized pistons 68 do in fact fill the diameter of the inner cavity 66 of each accumulator cylinder 48, and thus demarcate and divide the cylinders 48 in the aforedescribed manner. The floating magnetized pistons 68 are magnetized and installed within the inner cavities 66 to oppose in magnetic charge the charge of the permanent magnets 62.

As shown in FIGS. 1-4, a plurality (four) of oil reservoir fluid lines 74 extend from the oil reservoir 22 for interconnection to the one-way in valves 56 on the end caps 50 of both outer pressure cylinders 46. Mounted to each oil reservoir fluid line 74, and generally adjacent the oil reservoir 22, is one shutoff valve 76; thus four shutoff valves 76 are utilized. Fluid lines 78 then extend from the one-way out valves 58 on the end caps 50 of each outside pressure cylinder 46 for connection to the one-way in valves 56 on the end caps 64 on the adjacent inner accumulator cylinders 48. Fluid lines 78 are further connected to and extend outwardly from the one-way out valves 58 on the end caps 64 of the inner accumulator cylinders 48 for interconnection and flow registration to the main working pressure fluid line 16 that connects to some type of mechanical device such as the gearbox 12 of the hydraulic motor 14 in the representative example shown in FIGS. 1 and 4. The system also includes a rechargeable battery 80 for energizing the electromagnets 52 and an electrical programmer is utilized to program the electromagnets 52 of the pressure cylinders 46 in a predetermined sequence to be hereinafter further described.

In operation the outside cylinders 46 are utilized to build up and provide pressure for the adjacent inside cylinders 48 that serve as accumulators. The electromagnets 52 of the outside pressure cylinders 46 are programmed by the electrical programmer so that during operation of the system 10 for each pressure cylinder 46 there is simultaneous energization of one electromagnet 52 and the de-energization of the other electromagnet 52. This simultaneous energization and de-energization of the electromagnets 52 alternately attracts the floating pistons 60 to each end of the pressure cylinders 46 in a continuous back-and-forth or reciprocable manner. Concomitant with this reciprocable movement of the floating pistons 60 within the interior chambers 54 of the pressure cylinders 46, the one-way oil in valve 56 on each end cap 50 closes and this action, combined with the reciprocation of the pistons 60 results in the forcing of the fluid (oil) through the respective one way out valves 58 through the respective fluid lines 78 and through the one way oil in valves 56 on the end caps 64 of the adjacent inner accumulator cylinders 48. The aforedescribed actions occur simultaneously for each pair of pressure cylinders 46 and inner accumulator cylinders 48. As oil flows through the respective one-way oil in valves 56 of the end caps 64 of the inner cylinders 48 and into the fluid chamber portions 72 of the inner cavities 66, the air contained within the air chamber portions 70 is trapped and compressed between the floating magnetized pistons 68 and the permanent magnets 62 mounted at the opposite ends of the inner accumulator cylinders 48. It should be noted that the air trapped in the air chamber portions 70 of the inner cylinders 48 is not bled from the system 10. Trapping of the air in the air chamber portions 70 of the inner cylinders 48 creates the working pressure that forces out in a controlled and regulated manner, and as needed, the fluid (oil) contained within the fluid chamber portions 72 of the inner cylinders 48. The fluid (oil) is constantly forced out through the one-way oil out valves 58 on the end caps 64 of the inner cylinders 48 and travels through the main working pressure line 16 and the pressure regulator valve 30 to a mechanical device such as the hydraulic motor 14 thereby providing working pressure and powering the device with the fluid (oil) returning through the return line 18 to the oil reservoir 22 thus creating a continuous cyclic process for running a variety of devices, engines, and motors. Each pair of outer pressure cylinders and inner cylinder 46 and 48 are programmed in such a manner as to continuously maintain the desired working pressure within the entire closed system that includes the device, engine, or machine and the portable remote electromagnetic power system 10.

Although the present invention has been described in relation to a particular embodiment thereof, many other variations and modifications, and other uses will become apparent to those skilled in the art; and, therefore, the present invention is to be limited not by the specific disclosure herein, but by a broad construal of the appended claims.

We claim:

1. A portable remote electromagnetic power system providing a continuous working pressure for powering a mechanical device, comprising:

a water tank;

an oil reservoir mounted on top of the water tank;

a pair of outer pressure cylinders extending transversely through the water tank;

a pair of inner accumulator cylinders extending transversely through the water tank and between the outer pressure cylinders so that one outer pressure cylinder can be operatively paired with one inner accumulator cylinder;

the outer pressure cylinders including a pair of oppositely disposed electromagnets;

a floating piston disposed within each outer pressure cylinder and capable of reciprocable movement between the electromagnets and in response to the energization and de-energization of the electromagnets;

each inner accumulator cylinder having a permanent magnet and an accumulator end cap oppositely mounted to each other;

a floating magnetized piston disposed within each accumulator cylinder and capable of reciprocable movement therein;

each inner accumulator cylinder further including an air chamber portion and a fluid chamber portion separated by the floating magnetized piston;

a main working pressure supply line interconnecting the inner accumulator cylinders to the mechanical device so that fluid under pressure can be delivered to the mechanical device for powering the mechanical device;

a plurality of fluid lines interconnecting the oil reservoir to the outer pressure cylinders and interconnecting each outer pressure cylinder to the adjacent inner accumulator cylinder for establishing fluid flow communication from the oil reservoir to the outer pressure cylinders and then the inner accumulator cylinders; and whereupon the energization and de-energization of the electromagnets of the outer cylinders actuates the reciprocation of the floating pistons concomitant with flow of fluid into the outer pressure cylinders at the end caps thereof whereby the reciprocation of the floating pistons then forces the fluid out of the outer cylinders through the fluid lines and into to fluid chamber portions of the adjacent inner cylinders trapping air in the air chamber portions for creating pressure that forces fluid out of the fluid chamber portions of the inner cylinders through the main working pressure line and to the mechanical device as continuous working pressure for powering the mechanical device.

2. The portable remote electromagnetic power system of claim 1 further comprising a fluid return line extending from the mechanical device through the water tank and back to the oil reservoir for returning fluid back into the oil reservoir.

3. The portable remote electromagnetic power system of claim 2 wherein the water tank is substantially filled with water that acts as a coolant for the fluid returning to the oil reservoir through the fluid return line.

4. The portable remote electromagnetic power system of claim 3 further comprising a rechargeable battery for energizing the electromagnets mounted to the outer pressure cylinders.

5. The portable remote electromagnetic power system of claim 4 further comprising a plurality of shutoff valves interposed between the oil reservoir and the outer pressure cylinders for shutting of the flow of fluid to the outer pressure cylinders.

6. The portable remote electromagnetic power system of claim 5 further comprising a pair of oppositely disposed end caps mounted to each outer pressure cylinder with each end cap enclosing therein one electromagnet.

7. The portable remote electromagnetic power system of claim 6 further comprising a pressure regulator valve mounted to the main working pressure supply line for regulating and controlling the flow of fluid to the mechanical device.

8. The portable remote electromagnetic power system of claim 7 further comprising an air breather and fill port mounted to the oil reservoir for bleeding air out of the oil reservoir and for filling the oil reservoir.

9. The portable remote electromagnetic power system of claim 8 further comprising a sight gauge mounted to the oil reservoir to allow for the visual determination of the amount of fluid within the oil reservoir.

* * * * *